United States Patent [19]

Kiernan et al.

[11] Patent Number: 4,972,854

[45] Date of Patent: Nov. 27, 1990

[54] APPARATUS AND METHOD FOR MANUFACTURING TOBACCO SHEET MATERIAL

[75] Inventors: Bernard C. Kiernan; Bernard A. Semp, both of Richmond, Va.; John M. Whitman, Lawrenceville, N.J.

[73] Assignee: Philip Morris Incorporated, New York, N.Y.

[21] Appl. No.: 356,756

[22] Filed: May 24, 1989

[51] Int. Cl.[5] ..... A24B 3/14; A23C 19/00

[52] U.S. Cl. ..... 131/353; 131/356; 131/357; 131/370; 131/372; 426/582

[58] Field of Search ..... 131/353, 356, 297, 357, 131/298, 370, 372, 373, 374, 375; 426/582

[56] References Cited

U.S. PATENT DOCUMENTS

| | | | |
|---|---|---|---|
| 2,747,583 | 5/1956 | Frankenburg et al. . | |
| 2,830,596 | 4/1958 | Frankenburg et al. . | |
| 3,097,653 | 7/1963 | De Gooijer . | |
| 3,176,964 | 4/1965 | Cottell et al. . | |
| 3,194,245 | 7/1965 | Clarke . | |
| 3,408,050 | 10/1968 | Jacobs . | |
| 3,415,253 | 12/1968 | Michels et al. . | |
| 3,605,757 | 9/1971 | Buchmann et al. . | |
| 3,889,004 | 6/1975 | Schmidt | 426/582 |
| 3,926,413 | 12/1975 | D'Urso . | |
| 4,058,129 | 11/1977 | Beringer et al. . | |
| 4,164,948 | 8/1979 | Beringer et al. . | |
| 4,319,593 | 3/1982 | Pinion et al. . | |
| 4,325,391 | 4/1982 | Schmidt . | |
| 4,337,783 | 7/1982 | Hooper et al. . | |
| 4,341,228 | 7/1982 | Keritsis et al. . | |
| 4,421,126 | 12/1983 | Gellatly . | |
| 4,515,542 | 5/1985 | Peschetz . | |
| 4,674,519 | 6/1987 | Keritsis et al. . | |
| 4,702,264 | 10/1987 | Graves, Jr. . | |
| 4,754,767 | 7/1988 | Graves, Jr. . | |

FOREIGN PATENT DOCUMENTS

| | | |
|---|---|---|
| 1116970 | 1/1982 | Canada . |
| 935212 | 8/1963 | United Kingdom . |

*Primary Examiner*—V. Millin

*Attorney, Agent, or Firm*—Charles B. Smith; Alan D. Smith

[57] ABSTRACT

An apparatus and method for manufacturing tobacco sheet material comprising the steps of acoustic mixing with ultrasonic vibration a slurry containing tobacco components and forming sheets of tobacco material by casting the slurry after acoustic mixing. Additionally, the slurry is mixed with subsonic vibration and low shear mixing before the slurry is acoustic mixed. The slurry may include sized tobacco stems, sized tobacco dust and extract solution.

16 Claims, 4 Drawing Sheets

APPARATUS AND METHOD FOR MANUFACTURING TOBACCO SHEET MATERIAL

BACKGROUND OF THE INVENTION

This invention relates generally to manufacturing tobacco sheet material and, more particularly, to an apparatus and method for the continuous sheet casting of tobacco sheet material.

One method for manufacturing tobacco sheet material is illustrated in the block diagram of FIG. 1. Tobacco stems 10 are washed 12, reduced to an appropriate size 14 (e.g., 12–400 mesh) and blended to be homogenous 16. Tobacco dust 18 is likewise reduced to an appropriate size 20 (e.g., 12–400 mesh) and blended to be homogenous 22. Then, these sized tobacco components are mixed together and mixed with an appropriate extract solution 24 to produce a slurry 26. The extract solution 24 facilitates extraction of pectin chemically bound in the tobacco components.

The next step in this process is time consuming: the slurry 26 must age for at least three to four hours 28. During the aging step 28, two changes in the slurry 26 take place which are essential to the subsequent casting of tobacco sheet material from slurry. First, pectin is extracted from the tobacco components and released into the slurry 26. Inclusion of pectin in the slurry 26 is necessary for bonding of the tobacco components into sheet material. Second, the slurry 26 absorbs fluid. This is commonly referred to as wetting. Sufficient wetting is necessary to form tobacco sheet material which is pliant and not brittle. Typically, the slurry 26 is pumped into a storage tank to age.

After the slurry has aged for approximately three to four hours 28, the manufacturing process continues. The slurry is first refined to further reduce the size of the tobacco components 30 and then the slurry is cast in conventional fashion to form tobacco sheet material. The casting process involves forming 32 and drying 34 the slurry.

Due to the long aging step 28, this method of manufacturing tobacco sheet material requires precise advanced planning. The need for tobacco sheet material must be accurately estimated more than three hours in advance. In addition, manufacturing must be timely scheduled so that fabrication and cleanup can be completed within scheduled work shifts.

To reduce or eliminate the long aging step, two other methods for manufacturing tobacco sheet material have been developed. The first method substitutes a binder solution for the extract solution 24. By adding binder to the slurry, the need to wait for natural pectin to be released from the tobacco components is eliminated. Such binder solutions may include adhesive or pectin obtained from an external source. Extrinsic pectin may be obtained from non-tobacco products. Examples of this approach are U.S. Pat. Nos. 4,164,948, 4,325,391, 4,337,783 and 4,702,264 and Canadian Pat. No. 1,116,970.

Adhesive or extrinsic pectin added to the slurrY is not chemically equal to pectin extracted from tobacco components in the slurry. Accordingly, tobacco sheet material manufactured with a binder solution is less natural than tobacco sheet material manufactured using an extract solution.

The second alternative method substitutes a high intensity mechanical mixer for the aging step. The high intensity mechanical mixer, in combination with an extract solution, quickly releases pectin from the tobacco components into the slurry. The mechanical mixer uses high shear mixing to extract the pectin. Wetting of the slurry takes place during the high shear mixing. Mechanical high shear mixing is energy intensive and reduces the size of the tobacco components. U.S. Pat. No. 4,674,519 discloses this method.

SUMMARY OF THE INVENTION

The present invention is embodied in an apparatus and method for manufacturing tobacco sheet material.

Specifically, the present invention utilizes acoustic mixing with ultrasonic vibration to extract pectin from tobacco components in a slurry. Separately, wetting of the slurry is performed by subsonic mixing the slurry with subsonic vibration. The subsonic mixing and accompanying wetting of the slurry is performed with low shear mixing. Subsequent to the extraction of pectin and the wetting of the slurry, the slurry is cast to form sheets of tobacco material.

The slurry may include sized tobacco stems, sized tobacco dust and extract solution.

The subsonic mixing may be performed either before the acoustic mixing or between the acoustic mixing and the casting of tobacco sheets, although it preferably takes place before the acoustic mixing.

Subsonic mixing means performs the subsonic mixing of the slurry. The subsonic mixing means includes pump means for pumping the slurry into the subsonic mixing means under pressure, a housing with an orifice for the slurry to enter and an outlet for the slurry to exit, and a blade disposed within the housing which vibrates at a subsonic frequency as the slurry is pumped past the blade.

Acoustic mixing means performs the ultrasonic mixing of the slurry. The acoustic mixing means includes pump means for pumping the slurry into the acoustic mixing means under pressure, a housing with an orifice for the slurry to enter and an outlet for the slurry to exit, and a blade-like obstacle disposed within the housing, wherein pumping the slurry through the orifice and past the blade-like obstacle causes the slurry to cavitate at an ultrasonic frequency.

BRIEF DESCRIPTION OF THE DRAWINGS

The above and other aspects and advantages of the present invention will become apparent from the following description of the preferred embodiment, taken in conjunction with the accompanying drawings, in which like reference characters refer to like parts throughout, and in which.

DESCRIPTION OF THE PREFERRED EMBODIMENT

Figure 1:
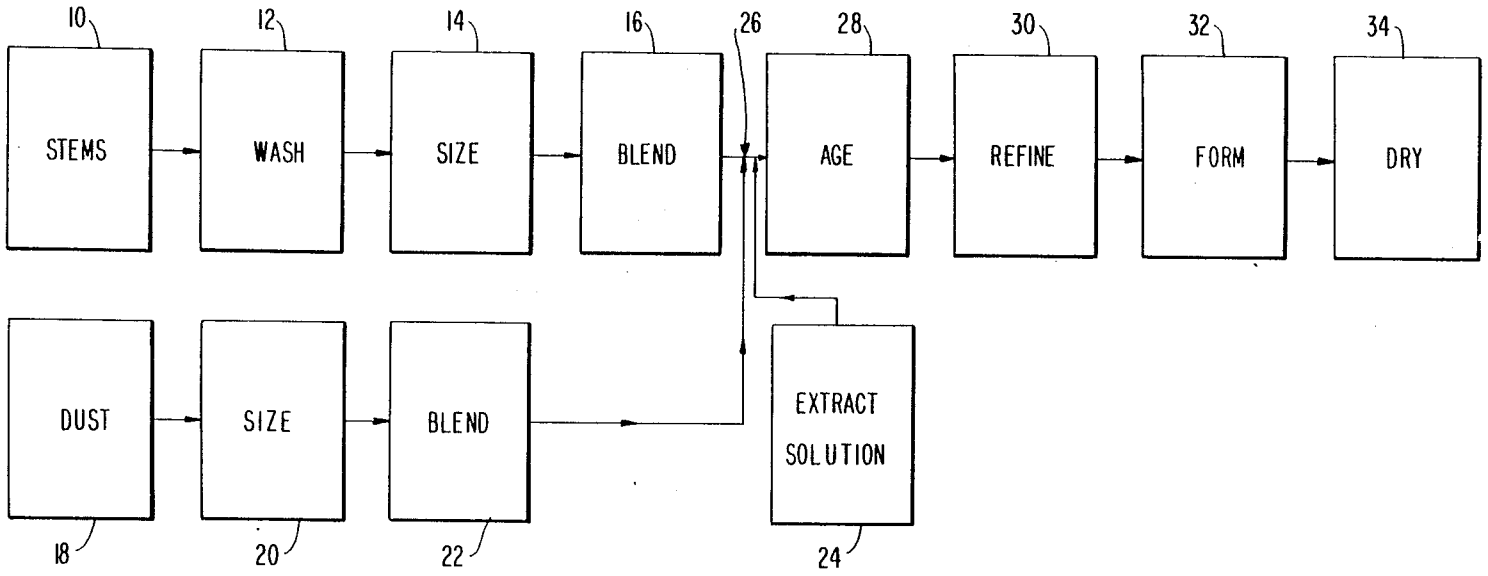
FIG. 1 PRIOR ART
FIG. 1 is a block diagram of a prior art method for manufacturing tobacco sheet material.
Figure 2:
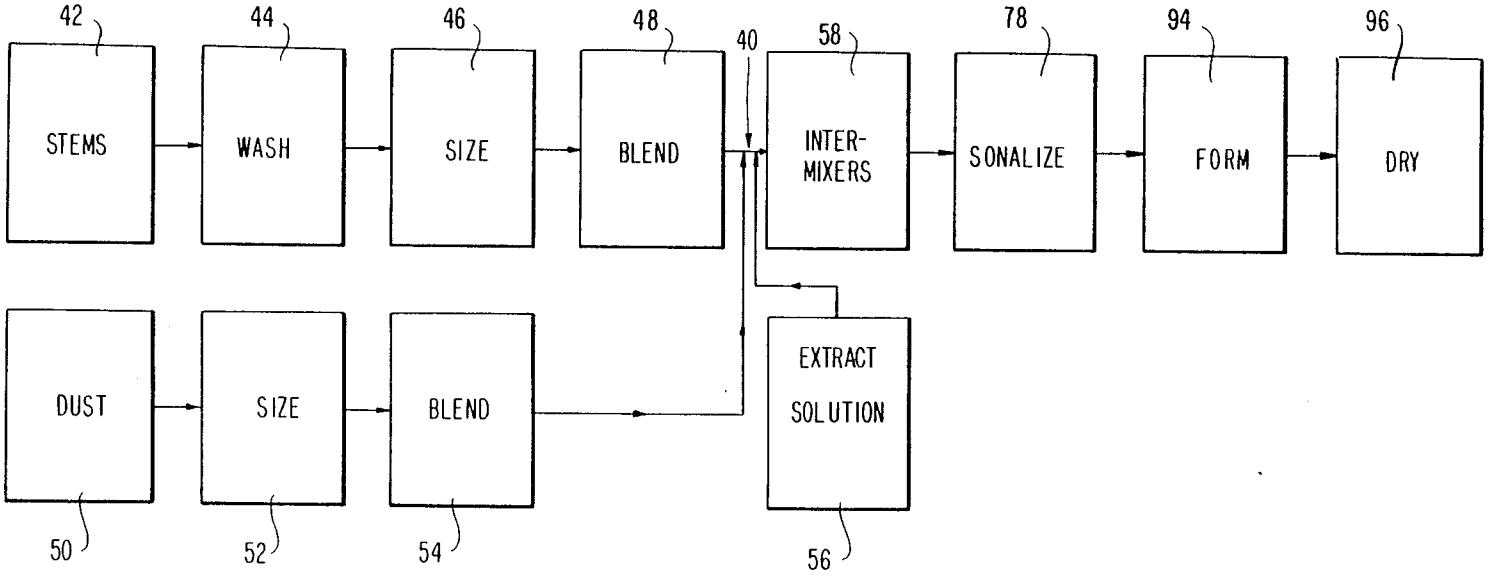
FIG. 2 is a block diagram of the method of the present invention for manufacturing tobacco sheet material.

As illustrated in FIG. 2, the preferred embodiment of the present invention provides continuous manufacturing of tobacco sheet material from a slurry 40 comprising prepared tobacco stems, prepared tobacco dust and extract solution.

The tobacco stems 42 are washed 44 and then sized 46 to pass through a 40 mesh screen. Although the tobacco stems in the preferred embodiment are sized to be less than 40 mesh, they could be up to 400 mesh. Grinding is used to reduce the tobacco stems 42 in size. The sized tobacco stems are accumulated and then blended to create a homogenous mixture 48. Similarly, tobacco dust 50 is sized 52 to pass through a 40 mesh screen (but could be up to 400 mesh) by milling, grinding, and/or screening and then blended 54.

The blended tobacco stems 48 and blended tobacco dust 54 are mixed together and then mixed with an extract solution 56 to produce the slurry 40. The extract solution 56 is added to the slurry 40 to facilitate the release of pectin chemically bound within the tobacco components and to provide fluid for absorption by the slurry. This fluid absorption is commonly referred to as wetting. The extract solution 56 can be any appropriate commercially available extract solution. The extract solution 56 of the preferred embodiment is a standard Philip Morris extract solution. In the preferred embodiment, the extract solution 56 is heated to a temperature between 100 and 200° F. and humectants and flavoring agents are added.

This invention advantageously separates the steps of wetting and pectin release. In the preferred embodiment, wetting of the slurry 40 is performed in two Intermixers 58 by subsonic vibration and low shear mixing. Pectin release takes place in a Sonolator 78 by acoustic mixing the slurry 40 with ultrasonic vibration. It has been found that wetting with low shear mixing, as opposed to high shear mixing, produces tobacco sheet material with better subsequent sheet integrity upon cutting. In addition, the combination of low shear mixing in the Intermixers 58 and acoustic mixing in the Sonolator 78 requires less energy than a conventional high intensity mechanical mixer.

Figure 3:
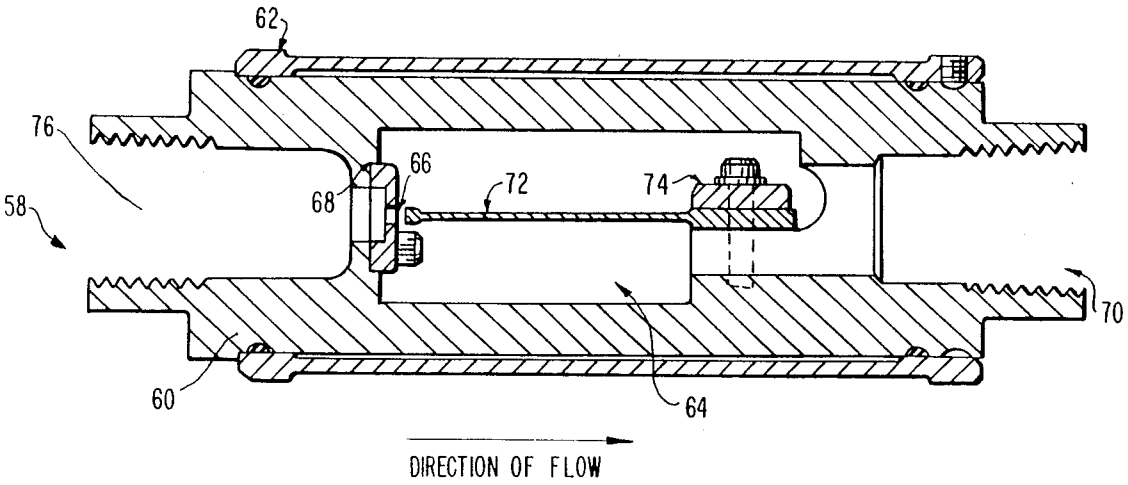
FIG. 3 is a cross-sectional view of a Sonic Intermixer.

The slurry 40 is pumped under pressure into two Intermixers 58 connected consecutively together. The preferred embodiment utilizes Intermixers manufactured and sold by Sonic Engineering Corporation ("Sonic"), Norwalk, Conn. Sonic holds U.S. Pat. No. 3,408,050 ("'050 patent") relating to its Intermixers. FIG. 3 is a cross-sectional drawing of the Intermixer 58. Of course, it is understood that this invention is not limited to use of this particular device. Other devices which perform the function of the Intermixer are also a part of this invention.

Each Intermixer 58 comprises a generally cylindrical body 60 with an exterior sleeve 62 and an interior mixing chamber 64. Slurry 40 enters the mixing chamber 64 through a rectangular orifice 66 having the configuration of a slot and an orifice gasket 68. The slurry 40 exits the mixing chamber 64 through an outlet 70. A blade 72 with a thickened tip and approximately the same dimensions and shape as the rectangular orifice 66 is disposed within the mixing chamber 64 and is secured to a blade block 74. The pumping of the slurry 40 under pressure past the blade 72 causes the blade to vibrate at its natural frequency, thereby mixing the slurry. The operation of a Sonic Intermixer is more fully described in Sonic's '050 patent.

In the preferred embodiment, the blade 72, whose distance from the orifice 66 is adjustable, is moved away from the orifice 66, thereby providing low shear mixing. Reducing shear mixing by increasing the blade to orifice distance is explained in the '050 patent (in particular, the paragraph bridging columns 5 and 6).

The blade 72 of the Intermixer 58 of the preferred embodiment vibrates in the range 50–250 cycles per second. This invention also contemplates other vibration rates within the subsonic frequency range.

The slurry 40 is pumped into the Intermixers 58 at a pressure between 5 and 60 psig, although the preferred embodiment operates at approximately 20 psig.

The subsonic low shear mixing of the slurry 40 accomplishes in a few seconds the necessary step of wetting the slurry. In the preferred embodiment, it has been found desirable to use two Intermixers 58 connected consecutively together (the outlet 70 of the first Intermixer connected to the entrance 76 of the second Intermixer) to allow the slurry 40 to absorb more fluid. It has also been found that tobacco sheet material can be manufactured by this invention with one Intermixer 58 or without the Intermixers 58, although such sheet material has less subsequent sheet integrity upon cutting.

The slurry 40 is pumped directly from the Intermixers 58 into a Sonolator Homogenizer 78 manufactured and sold by the Sonic Corporation ("Sonic"), Stratford, Conn. Sonic holds U.S. Pat. Nos. 3,176,964 and 3,926,413 relating to its Sonolators. Again, it is understood that this invention is not limited to use of this particular device. Other devices which perform the function of the Sonolator are also usable in carrying out this invention. The passing of slurry 40 to the Sonolator may also be delayed, although such a delay is not necessary.

The Sonolator 78 advantageously uses acoustic mixing to extract pectin from the tobacco components in the slurry 40 without significantly reducing the size of the tobacco components.

Figure 4:
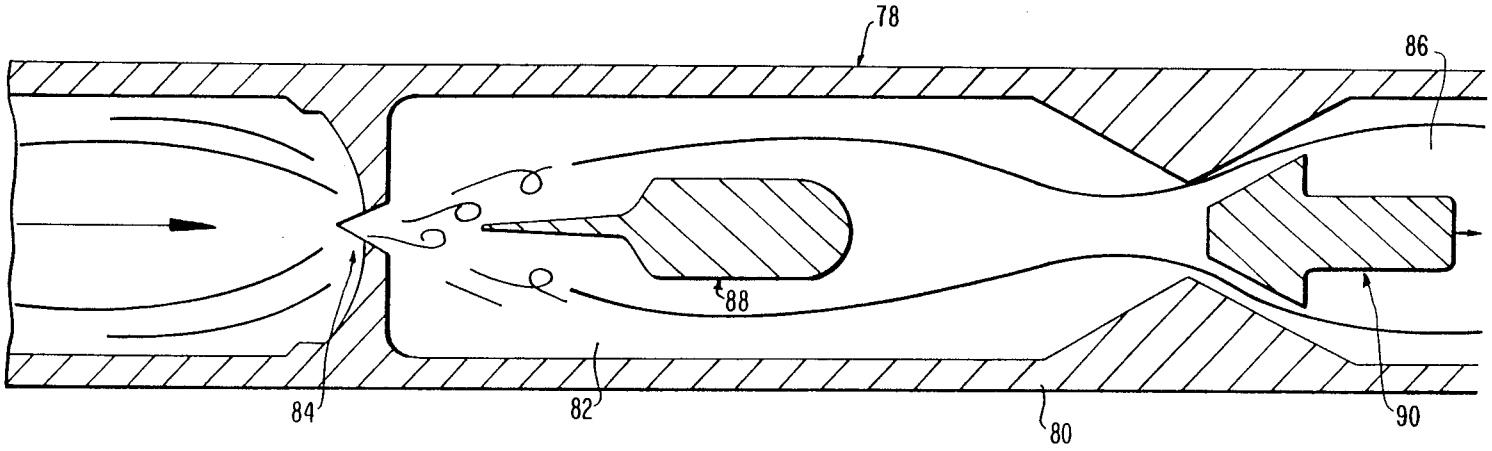
FIG. 4 is a cross-sectional depiction of a Sonic Sonolator showing the flow of slurry passing through the Sonolator.

FIG. 4 is a cross-sectional depiction of the Sonolator 78. The Sonolator 78 comprises a generally cylindrical housing 80 with an interior mixing chamber 82, an elliptical orifice 84 and an outlet 86. Disposed within the mixing chamber 82 is a blade-like obstacle which vibrates during mixing. A tuning valve 90 is disposed in the outlet 86.

The Sonolator 78 converts the kinetic energy of the high velocity slurry stream 40 into high intensity acoustic mixing energy. As shown in FIG. 4, the slurry 40 is pumped through the elliptical orifice 84 at a pressure between 4 and 1200 psig, although the preferred embodiment operates at approximately 500 psig, and is directed at the edge of the blade-like obstacle 88 in the mixing chamber 82. Between the orifice 84 and the blade-like obstacle 88, the slurry 40 sheds vortices perpendicular to the original flow vector. The shedding alternates in a steady oscillation in the sonic range. The sonic oscillations create a stress in the slurry 40 which causes the slurry to cavitate in the ultrasonic frequency range. The ultrasonic cavitation, combined with shearing and turbulence in the mixing chamber 82, shatters tobacco particles in the slurry 40 and emulsifies the slurry. This extracts pectin from the tobacco particles and releases the pectin into the slurry 40. The Sonolator 78 releases in seconds the pectin necessary for subsequent formation of tobacco sheet material. The operation of a Sonic Sonolator is more fully described in Sonic's U.S. Pat. Nos. 3,176,964 and 3,926,413.

Three parameters control the intensity of mixing activity in the Sonolator mixing chamber 82: pump to orifice pressure, orifice 84 to blade 88 distance and pressure within the mixing chamber 82. The intensity of mixing increases with greater pump to orifice pressure. The pump to orifice pressure may be increased by increasing the speed of the pump and/or decreasing the size of the orifice 84. Likewise, the pump to orifice pressure may be decreased by the reverse adjustments. The intensity of mixing can also be increased by decreasing the orifice 84 to blade 88 distance and/or increasing the pressure within the mixing chamber 82 by moving the tuning valve 90 towards the blade 88 to reduce the size of the outlet opening 86.

The Intermixers 58 are advantageously disposed before the Sonolator 78. The Intermixers 58 can more energy efficiently mix the slurry 40 before the Sonolator 78 emulsifies the slurry 40 to a viscous consistency. In addition, higher shear mixing would be required by the Intermixers 58 to sufficiently wet slurry having first been emulsified by the Sonolator 78. However, the Intermixers 58 and Sonolator 78 could be reversed in order.

Both the Intermixers 58 and the Sonolator 78 should have pressure gauges to monitor the pressure of the slurry 40. The Sonolator 78 should have an acoustic meter.

The slurry emerging from the outlet 86 of the Sonolator 78 is ready for immediate sheet casting. In the preferred embodiment, the slurry is directly passed from the Sonolator 78 to casting. The sheet is first formed 94 in conventional fashion and then dried 96 to produce tobacco sheet material.

Although the invention has been described in detail with reference to its presently preferred embodiment, it will be understood by one of ordinary skill in the art that various modifications can be made without departing from the spirit and scope of the invention. Accordingly, it is not intended that the invention be limited, except by the appended claims.

We claim:

1. An apparatus for manufacturing tobacco sheet material comprising:

a source of a slurry of tobacco components;

acoustic mixing means adapted to receive said slurry for acoustic mixing and slurry with ultrasonic vibration;

subsonic mixing means adapted to receive said slurry for mixing said slurry with subsonic vibration; and sheet forming means for forming sheets of tobacco material by casting and slurry subsequent to mixing by said acoustic mixing means and by said subsonic mixing means, wherein said subsonic mixing means is disposed either between said source and said acoustic mixing means for receiving said slurry from said source and transferring thereafter said slurry to said acoustic mixing means or between said acoustic mixing means and said sheet forming means for receiving said slurry from said acoustic mixing means and transferring thereafter said slurry to said sheet forming means.

2. The apparatus of claim 1, wherein said slurry includes sized tobacco stems and sized tobacco dust.

3. The apparatus of claim 2, wherein said slurry further includes an extract solution.

4. The apparatus of claim 1, wherein said subsonic mixing means is disposed between said source and said acoustic mixing means.

5. The apparatus of claim 4, wherein said subsonic mixing means mixes said slurry with low shear mixing.

6. The apparatus of claim 4, wherein said subsonic mixing means includes:

pump means for pumping said slurry into said subsonic mixing means under pressure;

a housing having an orifice through which said slurry is pumped into said subsonic mixing means and an outlet through which said slurry exits said subsonic mixing means; and a blade disposed within said housing which vibrates at a subsonic frequency as said slurry is pumped past the blade.

7. The apparatus of claim 4, wherein said acoustic mixing means includes:

pump means for pumping said slurry into said acoustic mixing means under pressure;

a housing having an orifice through which said slurry is pumped into said acoustic mixing means and an outlet through which said slurry exits said acoustic mixing means; and a blade-like obstacle disposed within said housing, wherein pumping said slurry through said orifice and past said blade-like obstacle causes said slurry to cavitate at an ultrasonic frequency.

8. An apparatus for manufacturing tobacco sheet material comprising:

a source of a slurry of tobacco components;

subsonic mixing means connected to said source to receive thereafter said slurry for low shear mixing said slurry with subsonic vibration, including pump means for pumping said slurry into said subsonic mixing means under pressure, a housing having an orifice through which said slurry is pumped into said subsonic mixing means and an outlet through which said slurry exits said subsonic mixing means, and a blade disposed within said housing which vibrates at a subsonic frequency as said slurry is pumped past the blade;

acoustic mixing means connected to said subsonic mixing means to receive thereafter said slurry for acoustic mixing said slurry with ultrasonic vibration, including pump means for pumping said slurry into said acoustic mixing means under Pressure, a housing having an orifice through which said slurry is pumped into said acoustic mixing means and an outlet through which said slurry exits said acoustic mixing means, and a blade-like obstacle disposed within said housing, wherein pumping said slurry through said orifice and past said blade-like obstacle causes said slurry to cavitate at an ultrasonic frequency; and sheet forming means for forming sheets of tobacco material by casting said slurry after said slurry is mixed by said acoustic mixing means.

9. A method for manufacturing tobacco sheet material comprising the steps of:

acoustic mixing said ultrasonic vibration a slurry containing tobacco components;

subsonic mixing said slurry with subsonic vibration; and forming sheets of tobacco material by casting said slurry after said acoustic mixing step and said subsonic mixing step, wherein said subsonic mixing step is either performed before said acoustic mixing step or performed after said acoustic mixing step and before said step of forming sheets.

10. The method of claim 9, wherein said slurry includes sized tobacco stems and sized tobacco dust.

11. The method of claim 10, wherein said slurry further includes extract solution.

12. The method of claim 9, wherein said subsonic mixing step is performed before said acoustic mixing step.

13. The method of claim 12, where in said subsonic mixing step includes mixing said slurry with low shear mixing.

14. The method of claim 12, wherein said subsonic mixing step includes pumping said slurry through a subsonic mixing means having a housing with an orifice for said slurry to enter said subsonic mixing means, an outlet for said slurry to exit said subsonic mixing means and a blade disposed within said housing, thereby causing said blade to vibrate at a subsonic frequency as said slurrY is pumped past said blade.

15. The method of claim 12, wherein said acoustic mixing step includes pumping said slurry through an acoustic mixing means having a housing with an orifice for said slurry to enter said acoustic mixing means, an outlet for said slurry to exit said acoustic mixing means and a blade-like obstacle disposed within said housing, thereby causing said slurry to cavitate at an ultrasonic frequency.

16. A method for manufacturing tobacco sheet material comprising the steps of:

mixing with subsonic vibration and low shear mixing a slurry containing tobacco components, including pumping said slurry through a subsonic mixing means having a housing with an orifice for said slurry to enter said subsonic mixing means, an outlet for said slurry to exit said subsonic mixing means and a blade disposed within said housing, thereby causing said blade to vibrate at a subsonic frequency as said slurry is pumped past said blade; then acoustic mixing said slurry with ultrasonic vibration, including pumping said slurry through an acoustic mixing means having a housing with an orifice for said slurry to enter said acoustic mixing means, an outlet for said slurry to exit said acoustic mixing means and a blade-like obstacle disposed within said housing, thereby causing said slurry to cavitate at an ultrasonic frequency; then forming sheets of tobacco material by casting said slurry.

* * * * *

UNITED STATES PATENT AND TRADEMARK OFFICE

CERTIFICATE OF CORRECTION

PATENT NO. : 4,972,854

DATED : November 27, 1990

INVENTOR(S) : Kiernan et al.

It is certified that error appears in the above-identified patent and that said Letters Patent is hereby corrected as shown below:

Column 1, line 61, "slurrY" should be -- slurry --.

Claim 1, column 5, line 42, "and" should be -- said --; and
line 47, "and" should be -- said --.

Claim 9, column 6, line 55, "said" should be -- with --.

Claim 14, column 7, line 15, "slurrY" should be -- slurry --.

Signed and Sealed this

Fifth Day of October, 1993

Bruce Lehman

*Attest:*

BRUCE LEHMAN

*Attesting Officer*

*Commissioner of Patents and Trademarks*